US005172530A

United States Patent [19]

Fishel et al.

[11] Patent Number: 5,172,530

[45] Date of Patent: Dec. 22, 1992

[54] SOUND ATTENUATION PANEL ARRANGEMENT WITH CABLING ACCOMMODATING CAPABILITY FOR OFFICE FURNITURE SPACE DIVIDER SYSTEMS

[75] Inventors: Duane D. Fishel, Oswego; Donald V. Beaver, Brookfield, both of Ill.

[73] Assignee: Allsteel Inc., Aurora, Ill.

[21] Appl. No.: 609,898

[22] Filed: Nov. 6, 1990

[51] Int. Cl.[5] ..... E04H 1/00

[52] U.S. Cl. ..... 52/221; 52/36; 52/806; 52/239; 160/135; 160/351

[58] Field of Search ..... 52/220, 221, 239, 404, 52/806–808, 36; 160/351, 135

[56] References Cited

U.S. PATENT DOCUMENTS

| | | | |
|---|---|---|---|
| 3,021,916 | 2/1962 | Kemp | 181/33 |
| 3,316,624 | 5/1967 | Brudevold | 52/221 |
| 4,084,366 | 4/1978 | Saylor et al. | 52/615 |
| 4,084,367 | 4/1978 | Saylor et al. | 52/615 |
| 4,155,211 | 5/1979 | Saylor et al. | 52/809 |
| 4,254,171 | 3/1981 | Beggs et al. | 428/116 |
| 4,269,882 | 5/1981 | Carrillo et al. | 428/116 |
| 4,379,191 | 4/1983 | Beggs et al. | 428/118 |
| 4,433,021 | 2/1984 | Riel | 428/116 |
| 4,493,174 | 1/1985 | Arens | 52/239 X |
| 4,593,508 | 6/1986 | Curatolo | 52/239 |
| 4,630,416 | 12/1986 | Lapins et al. | 52/239 |
| 4,682,457 | 7/1987 | Spencer | 52/239 |
| 4,688,491 | 8/1987 | Herrera et al. | 108/50 |
| 4,896,469 | 1/1990 | Wright | 52/221 |
| 5,003,740 | 4/1991 | Dull et al. | 52/239 |

*Primary Examiner*—Richard E. Chilcot, Jr.
*Attorney, Agent, or Firm*—Lee, Mann, Smith, McWilliams, Sweeney & Ohlson

[57] ABSTRACT

A panel frame and an acoustical insert frame assembly therefor for office furniture space divider systems, which, as assembled, can be utilized in work stations for both sound attenuation and data and communication cable and wire equipment connection masking and pass through purposes as well as masking of slack purposes, in which the panel frame is formed by rigid top, bottom, and side rails to define an open center structure therebetween of quadrilateral configuration that forms the panel frame, and has the usual front and rear sides; the insert frame assembly is mounted on the panel frame to complete the panel, as by being mounted on the front side of the frame, or by having a separate but similar insert frame assembly mounted on the rear side of the frame; each insert frame assembly comprises a supplemental frame that seats within the panel frame open center and mounts within the supplemental frame composite material that both effects sound attenuation and, within the metes and bounds of the supplemental frame, presents an area of and through the insert frame assembly that is cutable, and in "the field" if desired after installation, to form aperturing for local accommodation of data and communications cabling and wiring, as for slack take up of same within the panel, or for pass through purposes through the panel, or both, with the location or locations of such aperturing thus being at the option of the panel user.

7 Claims, 5 Drawing Sheets

SOUND ATTENUATION PANEL ARRANGEMENT WITH CABLING ACCOMMODATING CAPABILITY FOR OFFICE FURNITURE SPACE DIVIDER SYSTEMS

This invention relates to a panel for office furniture space divider systems having local accommodation capability for data and communication wiring and cables, and, more particularly, to a panel for office furniture work stations and the like that includes a rigid frame of the usual quadrilateral configuration that is also open centered in addition to defining the usual front and rear sides, with the panel frame removably mounting on both the front and rear sides of same, identical special acoustical insert frame assemblies, or removably mounting on its front side only a single such assembly, that adapts the panel to accommodate local data and communication wiring and cable needs as well as for slack take up or panel pass through purposes. The special acoustical insert frame assembly of the invention includes as a supplemental composite body a supplemental frame mounting a sound attenuation composite unit that is positioned to dispose the rear side of same within the panel frame open center but short of the panel frame center plane, with the composite unit involved including cutable or formable sound attenuation materials that, in addition to sound attenuation, also enables the supplemental body to present an area of and through the panel body side formed by same, and within the metes and bounds of the supplemental frame, that extends transversely through the resulting panel body side for aperturing formation for slack take up, or passing therethrough, of cabling and wiring to be used at the location of the panel, with the location or locations of such aperture or apertures to be formed in the panel body (within such metes and bounds) being at the option of the panel user and, either "in field" formable, or permitting formation of such aperture or apertures at the time of assembly of such panel, for future accommodation by the panel of data and communication cabling or wiring, as when electrical and/or electronic equipment used or to be used in connection with the panel is to be put into use.

It is common practice in the office furniture field to, using free standing demountable panels, some times called panel walls, subdivide a relatively large interior space (of an office building or the like) into what have become known as work stations. As is also well known, such work stations may be of a selection of configurations, such as the familiar sub-room type grouping of the panels employed, or by disposing the panels making up the work station in the familiar "T", "X", "Y", or 90 degree type configurations.

Regardless of the use to which the panel is employed or the work station configuration involved is employed, it is also common practice that the individual panels employed for these purposes, including those of the prewired type and these arranged for later prewiring, each comprise a rigid frame formed by vertical and horizontal usually metallic, frame members that define a rectangular frame in which is fixedly mounted a panel body that normally fills the space defined by the panel frame, and that is normally defined by rigid and non-penetrable metallic and/or plastic materials (or both), to which suitable decorative coverings are applied to either side of same, and its ends, as needed, for strengthening purposes and compatibility as to decor considering the environment in which the panel is to be mounted. Such panels normally have a front side that faces the panel user when the panel is erected, and a rear side which may not be at all decorated and faces away from the user. It is also common practice to equip such panels to mount such familiar non-electrical equipment as cabinets, shelves, worksurfaces, etc. and such familiar electric and/or electronic equipment as typewriters, duplicators, computers, etc.

As to prewired panels, such panels are prewired and socketed for connection to the available power source for utilization of electrical equipment located at the work station; panels that are arranged for later wiring are of suitable configuration for that purpose.

In any event, it is also common practice to bring cabling and wiring to or through the work station by running same through one or more of the work station panels, in the case of power wiring and cable that operates at line voltage, such wiring and cabling is typically strung through the work station panel bases, while in the case of data and communication wiring and cabling and low power wiring and cables, the work station panels involved at their tops are equipped with a through or upwardly facing channel in which the wiring and cabling involved are typically laid, with the trough or channel employed for this purpose being suitably covered by appropriate top capping or the like.

In the recent past, the use of computers and their CRT's or other computer output display devices, particularly for automation, have become increasingly popular in the business world. When, for instance, the work station involved is to have electrical and/or electronic equipment of any type, the practice has been to arrange the work station wiring and cabling so that, as it is mounted at the work station, it is power connected, and as to the wiring and cabling at the top and base of the panel, the appropriate wiring and cabling is brought to and from the equipment involved, as for connection purposes, and over the front face of the work station panel; these wiring and cabling lengths are unsightly, and they frequently involve slack that is unsightly and may require additional equipment to cover. Further, where the work station paneling involved does not provide such wiring and cabling, and electrical and/or electronic equipment is to be used at the work station, the equipment cabling or wiring and plugs therefor must somehow be manually connected to available electrical outlets, such as the familiar building wall mounted receptacle. This need in the past has been all too frequently met by stringing the cabling or wiring to one side of the panel involved or over same to extend the cabling and wiring so that the plug of same will reach the available electrical receptacle that is usually mounted outside the work station or to one side of the panel on an existing wall of the office building involved or some times at the building floor or ceiling. All too frequently the user of, for instance, the work station, or panel provided for its use, finds that the cabling or wiring of the equipment is to operate is not long enough for the cabling or wiring plug to be applied to the available electrical outlet receptacle, if the cabling or wiring must be strung to one side of the paneling involved or over the paneling involved to reach the electrical outlet receptacle or receptacles in question. Extension wiring or cabling are not considered to be a feasible answer to this problem (it is actually banned in some municipalities).

The principal object of the present invention is to provide a panel arrangement, of the office furniture type, that is of the sound attenuation type, and that is arranged to permit the option, across a major surface portion of the front of the panel body, of forming a bore or aperture through the panel body either as part of the pre-use manufacture of the panel, or "in field" after the panel has gone into use (for instance, as part of a work station), and at the location or locations desired for the panel at that time or any time thereafter, when electrical and/or electronic equipment is to be used by the panel user, and forming the panel frame, for passing connecting wiring and cabling vertically through the panel and behind its front surfacing, from the panel tops and bases, and through, for instance, the indicated aperture to the equipment in question with all slack in same returned through such aperture for masked or hidden storage behind the panel front surfacing, or for cabling and wiring complete pass through purposes (for connection to the nearest building mounted outlet receptacle).

Another object of the invention is to provide a panel arrangement involving a panel rigid marginal frame of the usual size and quadrilateral configuration that is also of "open center" configuration within its frame, and an acoustical insert frame assembly therefor, of which a sole such assembly may be mounted on the front side of the panel frame, or separate such assemblies are mounted on the front and rear sides of the frame, to form the panel body, with each such assembly providing a composite unit that presents an area of and transversely through the assembly, across a major portion of same within the acoustical insert frame assembly, that is transversely cutable through the assembly for bore or aperture formation therethrough, and thus through the panel front facing, for purposes of passing cabling and wiring therethrough, and at optional locations along such assembly major portion; which area is also of limited thickness so that when such assemblies are mounted on both the front and rear sides of the same panel frame, a hollow space is provided that receives the indicated wiring and cabling.

Another object of the invention is to provide a panel arrangement for office furniture use in which the panel comprises a panel frame that provides the basic strength and rigidity of the panel, that is of "open center" configuration, and that receives one forward or both forward and rearward acoustical frame assemblies that form the body of the panel, each of which assemblies is only as strong as it needs to be to remain assembled; such assemblies are also to include a sound attenuation mass that extends across a major portion of the panel, that in addition to its sound attenuation characteristics, also is formable over such major portion thereof, lengthwise and heightwise of same, to be transversely cutable therethrough for bore or aperture formation, for passing cabling and wiring therethrough as needed, and at optional locations heightwise and widthwise of such panel body major portion.

Still another object of the invention is to provide a panel arrangement for office furniture use in which the panel arrangement may, as part of its pre-use assembly, or after its installation, have the needed aperture or apertures formed in such major portion of the panel body of same, to which are preferably applied for each aperture or bore involved, a grommet such as of the type disclosed in Herrera and Wurgler U.S. Pat. No. 4,688,491, granted Aug. 25, 1987 (the disclosure of which is incorporated herein by this reference), which grommet includes a closing cover to be applied to the exterior surfacing of the panel so that the panel may be equipped with such grommet for use of the grommet in its closed and empty, dormant, condition, for use when needed in connection with the electrical and/or electronic equipment of the type indicated; one of the advantages of using this grommet (which was designed for office furniture desk top use) is that the grommet is proportioned to pass also the plugs for the cabling or wiring involved, so that it is not necessary to remove the cabling or wiring from the plug prior to retracting the cabling or wiring involved through the panel, when the electrical and/or eletronic equipment involved is to be moved.

The invention contemplates, among other things, the following:

Among the specific types of wiring and cabling referred to are coaxial cable, twisted wire telephone lines (wire in pairs twisted together), twisted wire telephone line bundles (each having 25 pair of lines), and fiber optic lines.

The panel insert assembly or assemblies in addition to being acoustical should be strong enough to resist denting, be fire resistant, and the front face of each should be tackable so that sheets of papers bearing notes can be applied anywhere on same with thumb tacks, or within the cutable area of same with the longer common T-pin (that is approximately one and one-half inches long for multipage reports and the like).

In accordance with the invention, the panel involved comprises a panel frame and body therefor, of which the panel frame is formed by rigid top, bottom, and side rails to define an open center structure therebetween of quadrilateral configuration of suitable dimensioning and having the usual front and rear sides, with the frame top and bottom rails being centrally ported for passing connecting wires and cabling therethrough for connection to electrical and/or electronic equipment involved in a largely hidden manner within the panel. Associated with the panel frame at its front side is an acoustical insert frame assembly that forms the body of the panel and is suitably mounted on the front side of the panel frame, as by being hung from the upper ends of the frame side rails at the front side of same. Alternately, the rear side of the panel frame may be similarly equipped with a like acoustical insert frame assembly.

Each acoustical insert frame assembly comprises a supplemental frame that seats within the panel and mounts composite material including a composite honeycomb subassembly that is disposed, when the assembly of the panel is completed, within the open center of the frame, with the composite material involved, including the honeycomb layer, being cutable transversely of the panel for aperture formation for passing therethrough a vertically extending length of the masked wiring and cabling for connection to the equipment involved, or for receiving access slack in same after the wiring or cabling is connected to the equipment in question, for masking purposes. Where the equipment is to require its own cabling or wiring be electrically connected directly to the nearest building mounted outlet receptacle, the aperture, and a similar aligned aperture formed in any insert assembly mounted on the panel rear side, permit such wiring or cabling to be passed entirely through the panel for application to wall mounted electrical receptacles or the like to energize such equipment. The composite body involved in the respective insert assemblies presents an area of and transversely through the subassembly involved and within the metes and bounds of the supplemental frame that seats the honeycomb unit, in which such aperture or apertures may be formed, or permitting the formation of such aperture or apertures later but at the time of need, and at the option of the user of the equipment as to location anywhere on or in such area. In either panel embodiment indicated, the cutable condition provided is in effect through or transversely of the panel itself.

The resulting panel not only has familiar sound attenuation characteristics, but also presents a fabric type front facing decorative appearance; these panels may be used in the same manner as any conventional panel for office furniture, including one of the work station configurations hereinbefore suggested, and provides the advantages of both sound attenuation and cabling or wiring masked egress in the plane of the panel and/or pass through the panel front facing, or even through the entire panel itself; the panel sound attenuation characteristics are always available to the panel user, and the ability to form apertures can be either utilized in the pre-use manufacture of the panel, or be available as needed during the panel use.

Other objects, uses, and advantages will be obvious or become apparent from a consideration of the following detailed description and the application drawings, in which like reference numerals indicate like parts throughout the several views.

In the drawings:

FIG. 1 is a small scale perspective view of the front side of three panels arranged in accordance with the present invention that are suitably connected together in work station manner, for work station use, with one of the panels conventionally supporting a conventional cabinet and another of the panels conventionally supporting a conventional shelf, with the three panels of FIG. 1 having the acoustical insert frame assembly of the present invention (that forms the body of the respective panels) being a single such assembly mounted on the front side of the frame involved;

FIG. 2 is an exploded perspective view of one corner of one of the panels involved in the work station of FIG. 1, namely the upper left hand corner of same, showing the corresponding parts of the panel frame, and the acoustical insert frame assembly that is to be applied to the front side of the panel frame to form the panel body, using the conventional hook type support arrangement illustrated in FIGS. 2 and 5, and showing also a grommet of the type disclosed in the aforementioned U.S. Pat. No. 4,688,491, and a plug of the composite material that has been removed by cutting same in the portion of such body that is formed of materials suitable for this purpose, for application of the grommet to such panel, by pressing the grommet into the resulting through aperture formed in the panel body and thus the panel;

FIG. 3 is an exploded perspective view of the acoustical insert frame assembly itself, on a smaller scale for illustrative purposes, showing the manner in which the honeycomb unit forming a part of such assembly seats within the insert frame assembly supplemental frame involved, and showing also the acoustical insert frame assembly fibrous sound absorbing mat that is to overlie the honeycomb unit (see FIG. 4) displaced from the honeycomb unit, and a portion of the fabric sheeting (also disclosed) that is to cover the front side of the sound attenuating material carried by the acoustical insert frame assembly supplemental frame, see also FIG. 4 (which thus forms the body of the panel in this embodiment of the invention);

Figure 1:
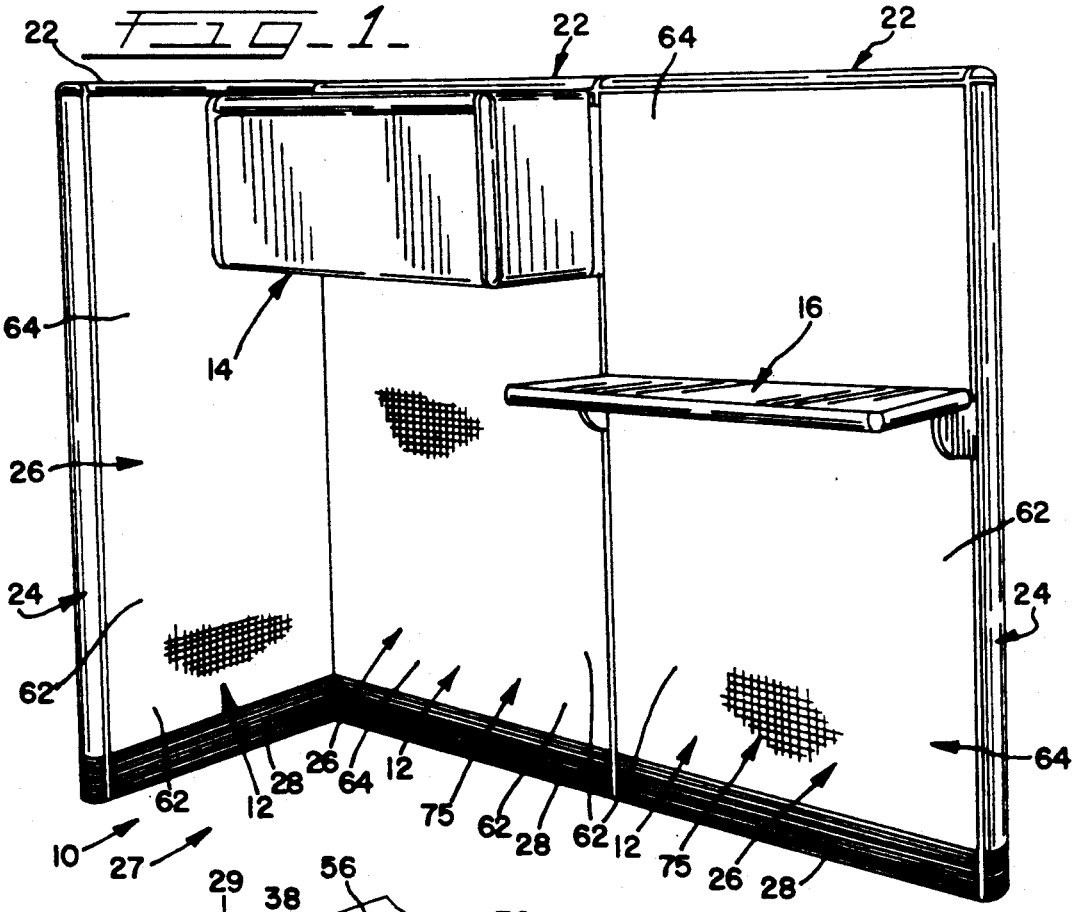
Figure 2:
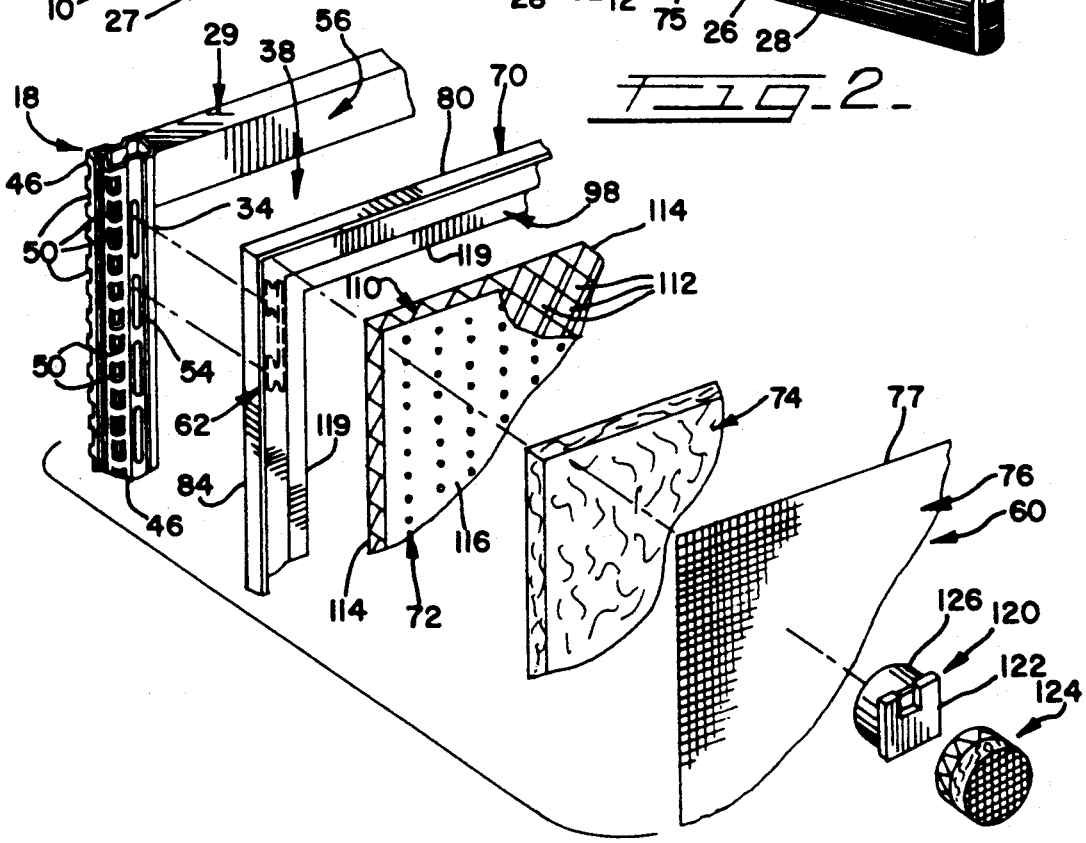
Figure 6:
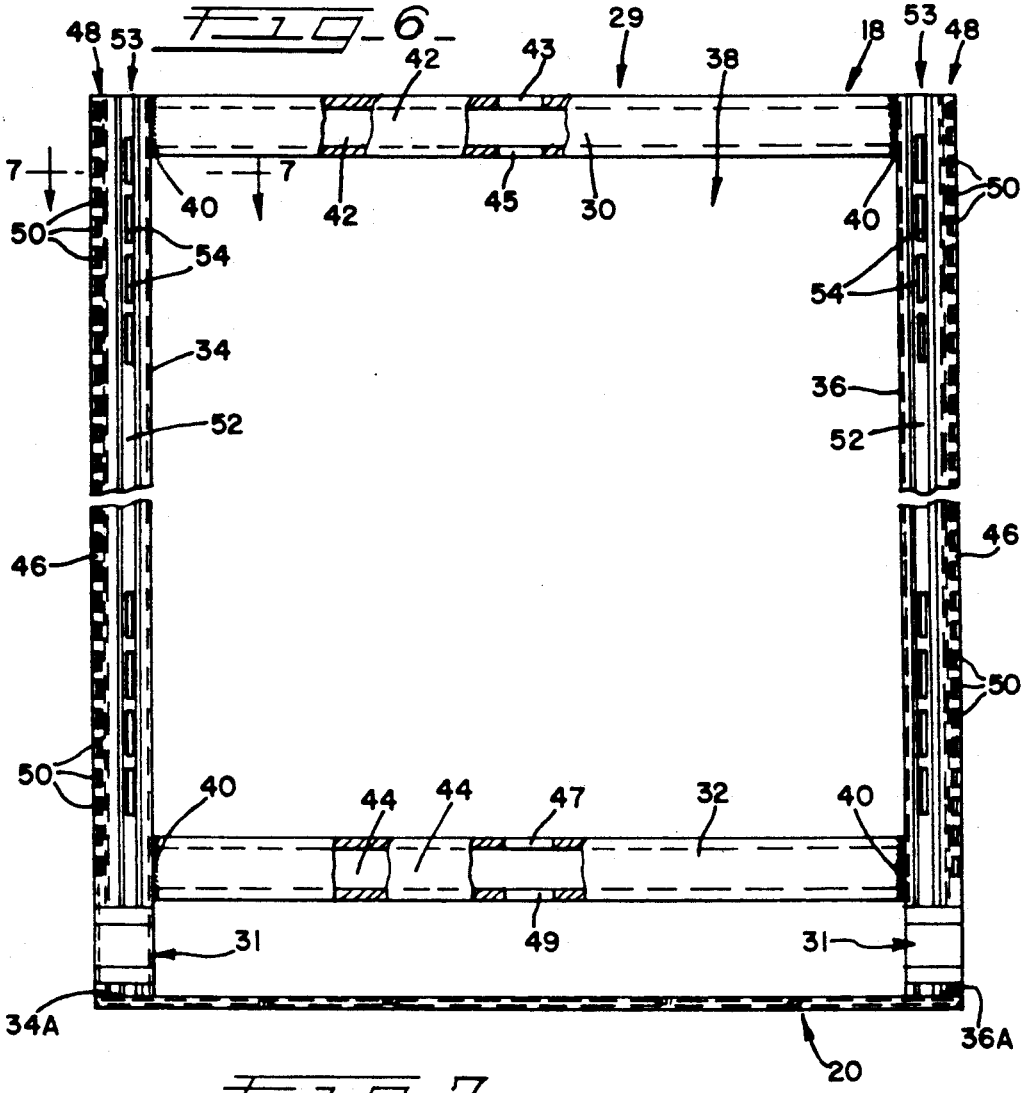
Figure 7:
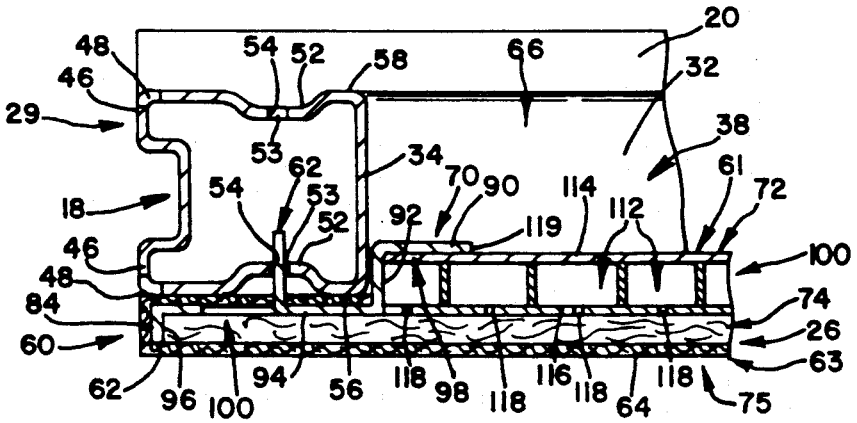
Figure 8:
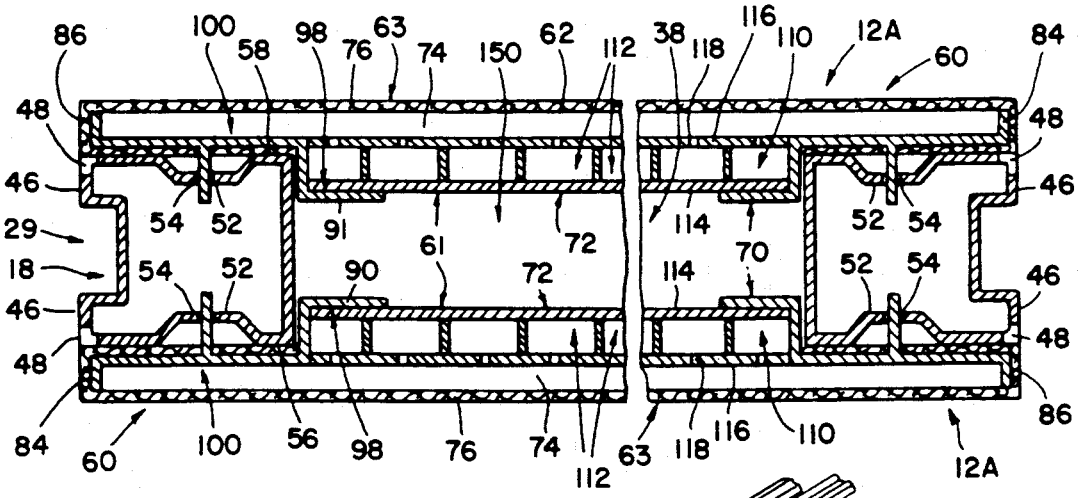
Figure 9:
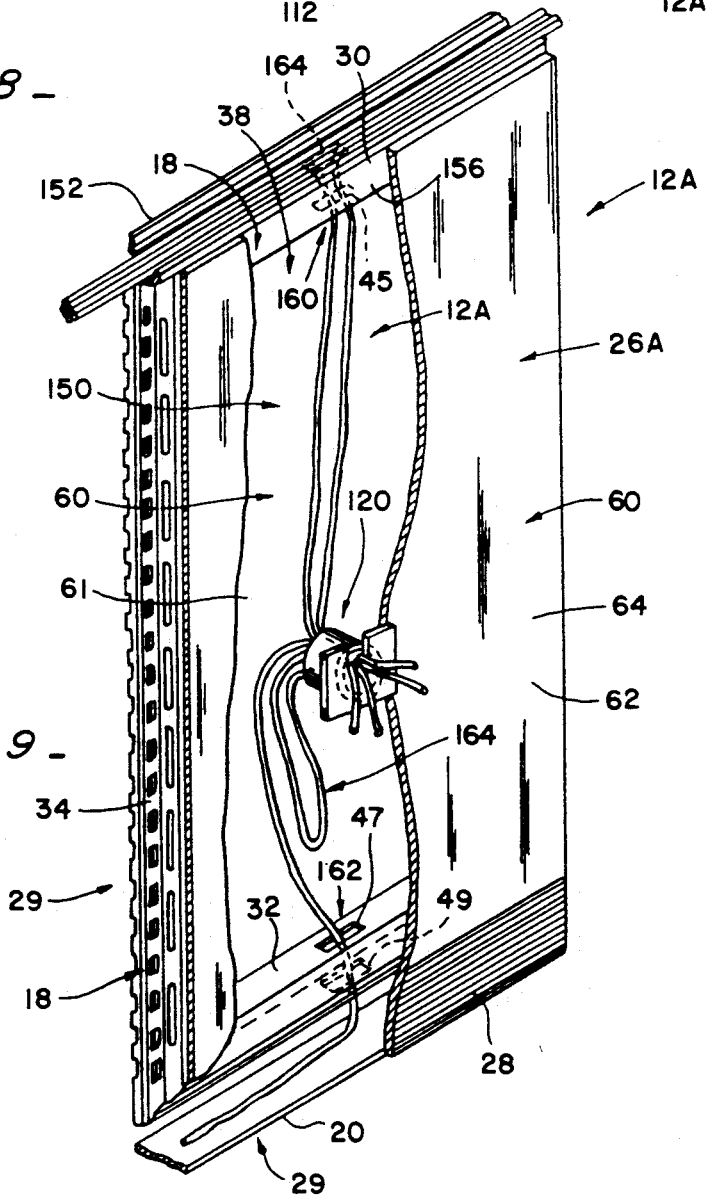
Figure 10:
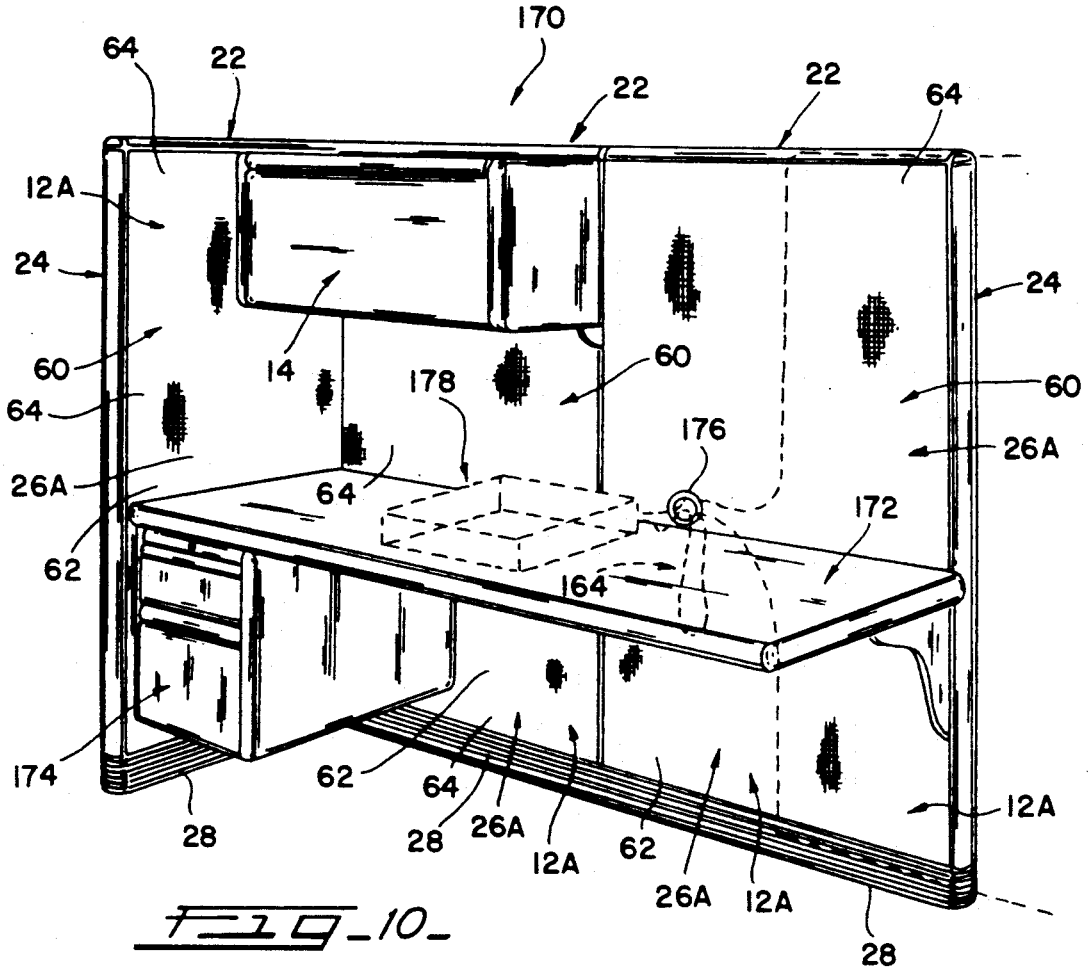
Figure 11:
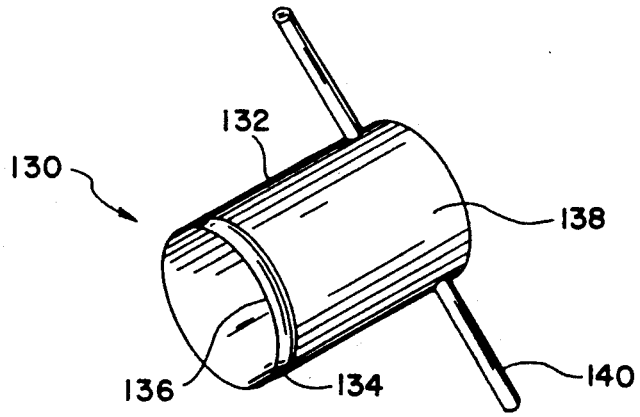

FIG. 6 diagrammatically illustrates one commercial form of panel frame of the type employed in the panels of FIGS. 1 and 2, with parts of the frame side rails broken away;

FIG. 7 is a sectional view of the panel frame of FIG. 6, with the acoustical insert frame assembly of FIGS. 2–5 applied to the front side of same, in accordance with the present invention, on approximately line 7—7 of FIG. 6, showing in plan the conventional bottom channel assembly that is applied to the particular panel frame of FIGS. 1, 2, and 6;

FIG. 8 is a view similar to that of FIG. 7, but showing the aforementioned panel embodiment in which has separate but identical acoustical insert assemblies (arranged in the same manner as shown in FIGS. 2–7) applied to both the front and rear sides of the panel frame, leaving a hollow space therebetween;

FIG. 9 diagrammatically illustrates in use a typical panel of the type shown in FIG. 8;

FIG. 10 is similar to FIG. 1 but involves a work station made up of panels arranged in accordance with FIG. 8, and indicating in dashed lines one use of same; and FIG. 11 diagrammatically illustrates in perspective one form of panel body cutting tool that may be employed to form the panel body apertures contemplated by the present invention.

However, it is to be distinctly understood that the specific drawing illustrations provided are supplied primarily to comply with the requirements of the Patent Laws, and that the invention is susceptible of modifications and variations that are intended to be covered by the appended claims.

GENERAL DESCRIPTION

Reference numeral 10 of FIG. 1 indicates a work station that is made up of three of improved panels 12 (see FIGS. 2–7), representing one embodiment of the invention, connected together to form a work station arrangement. One of the panels 12 has conventionally applied to same a conventional cabinet 14 while another of the panels 12 has conventionally applied thereto a conventional shelf 16, both for purposes of illustration.

Panels 12A of FIGS. 8–10 illustrate a second embodiment of the invention.

The individual panels 12 and 12A each include the rigid panel frame 18, that is more specifically shown in FIGS. 2, 6, 7, and 8 and that is operably associated with the respective special panel bodies 26 (see FIGS. 2–6) and 26A (see FIGS. 8–10) and a conventional bottom channel assembly or base 20 (see FIG. 7) that is to engage or set upon the floor (not shown) of the building (in which the panels 12 and 12A are employed as part of the illustrated work stations are utilized) for "free standing" purposes.

The panels 12 of the work station 10 are connected in any conventional manner to form the work station 10, with the panels 12 being provided with suitable conventional top caps 22, and the end panels 12 of the work station 10 being provided with suitable conventional side or end caps 24 that may be applied thereto in any conventional manner.

In each panel 12, the panel body 26 overlies the respective panel frames 18 on the front or working side 27 of the work station; in the illustrated embodiment of FIG. 1, in the case of each panel 12, this is down to a decorator panel 28 at the panel base 29 that is suitably affixed to the respective panel frames 18 (where indicated at 31 on FIG. 6), the decor of which is "carried around" end caps 24 for the specific work station shown in FIG. 1. The panels 12 are normally rectangular in configuration, and are made to size as needed for use of a particular panel 12 in a work station or otherwise.

The general arrangements of the individual panel frame 18 and the panel bodies 26 therefor (note the acoustical frame assembly 60) are diagrammatically illustrated in FIGS. 2–7.

FIGS. 8–10 illustrate the modified panel 12A, with the panels 12A of same being arranged as shown in FIG. 8, so that an acoustical insert assembly 60, that forms the panel body 26 in the panel embodiment of FIGS. 1–7, is mounted in the front side of the frame and a separate such assembly 60 is mounted on the rear side of same (panels 12A being otherwise the same as panel 12). The thickness proportioning of the assemblies 60 is also the same in both embodiments, creating the panel rear indentation indicated in FIG. 7, and the panel centrally disposed hollowness that is indicated in FIG. 8. Work station 170 of FIG. 10 is formed by panels 12A.

SPECIFIC DESCRIPTION

The panel frame 18 for both panels 12 and 12A comprises, in the form illustrated, a basic framework 29 comprising a rigid top rail 30 and rigid bottom rail 32 applied by the practice of a suitable bonding technique between a pair of side rails 34 and 36 to define the usual quadrilateral configuration (rectangular in the illustrated embodiment) that is also open centered as at 38 for the purpose of receiving the panel body 26. In the form illustrated, framework 29 of each frame 18 as the inside rails 34 and 36 extended as indicated at 34A and 36B (see FIG. 6) and suitably secured to the bottom or base channel assembly 20 that conventionally is one of the conventional panel base arrangements employed to support the panels 12 and 12A in free standing relation on a building floor or the like. The side rail segments 34A and 36A are also suitably and conventionally arranged as indicated at 31 (see FIG. 7) for securement of a decorated panel 28 thereto.

The rails 30, 32, 34, and 36 of the panel frame 18 are preferably formed from metal, such as a suitable steel, with the top and bottom rail members 30 and 32 being affixed to the respective side rail members 34 and 36 as at 40, as by the practice of suitable welding techniques. The rails 30 and 32 as well as rails 34 and 36 otherwise may be conventional in structural arrangement, with such rails also preferably being tubular. The configuration defined by the frame 18 as completed is to be of suitable quadrilateral shape, with the planar side surfaces 42, 44, of the top and bottom rails 30 and 32 being coplanar with the plane of the frame 18. As indicated in FIG. 6, the side rails 34 and 36 are similar and tubular in nature, with the rail 34 being diagrammatically illustrated in transverse section in FIG. 7. In the form of the side rails 34 and 36 that are illustrated, such side rails each include at the outer sides of same opposite corners 46 that are each formed with a row 48 of elongate apertures 50 (see FIG. 7) that in the work stations 10 and 170 at the front of the work stations are employed to conventionally mount in place (using conventional hanging techniques) such conventional equipment, as cabinet 14 and the conventional shelf 16 of FIG. 1; side rails 34 and 36 are also side indented as at 52 (at what are to be the front and rear sides of the frame) and are there formed with a row 53 of slots or apertures 54 for equipment hanging purposes, these conventional slots 54 being employed in connection with the present invention.

The panel frame 18 thus forms front side 56 and rear side 58 (see FIG. 7). Further, in accordance with the present invention the top rail member is apertured at 43 and 45, and bottom rail member is apertured at 47 and 49 for wire and cabling pull through, in a manner similar to that shown in FIG. 9, as will be described hereinafter.

Figure 3:
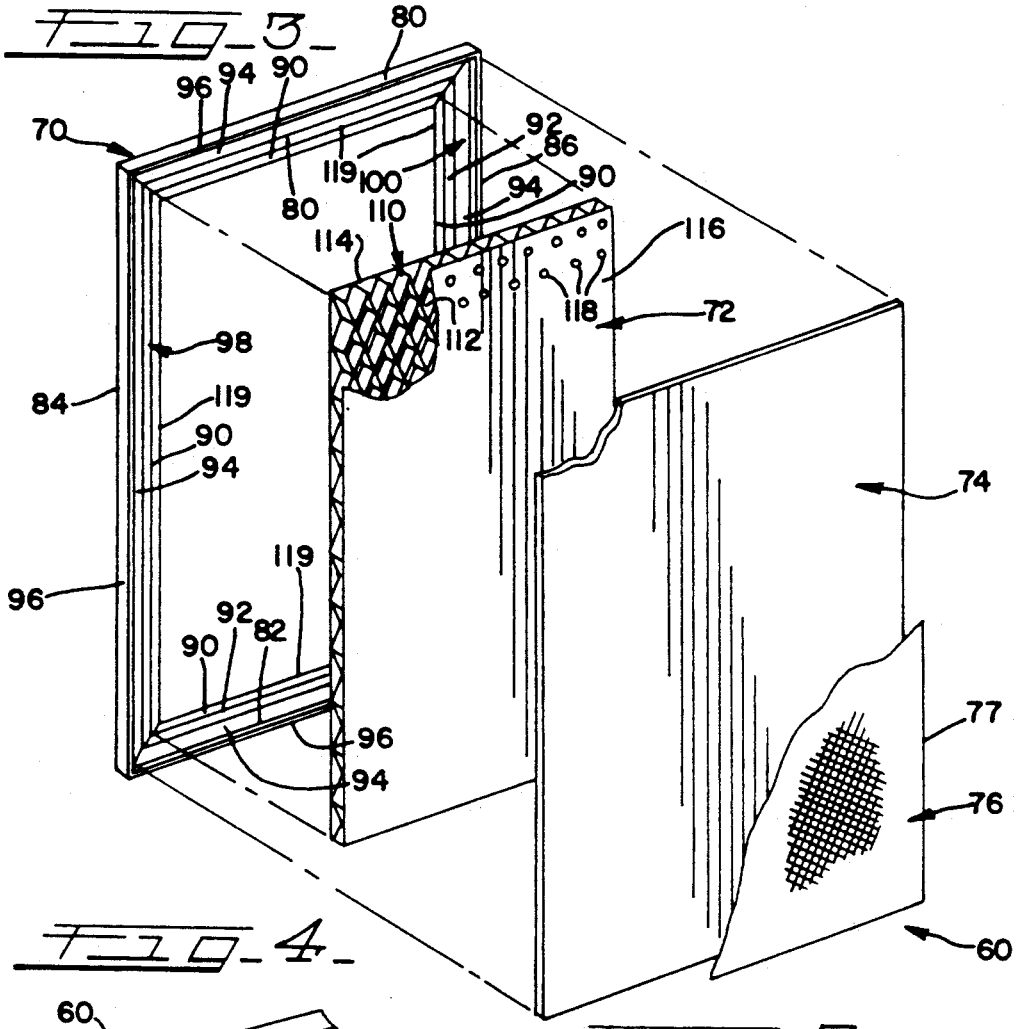
Figure 4:
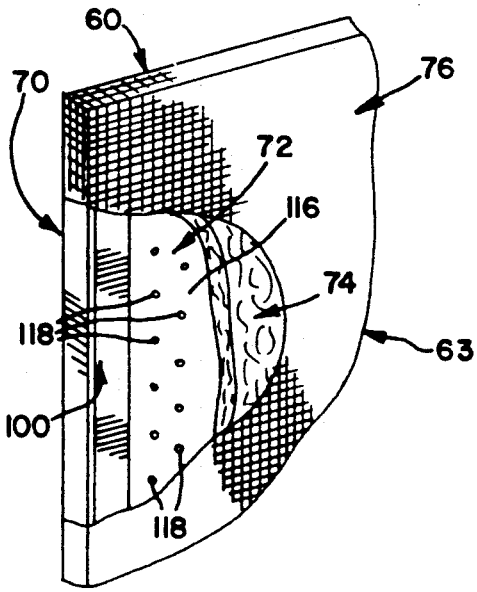
FIG. 4 is a fragmental perspective view, with parts broken away, that illustrates the upper left hand corner of the acoustical insert frame assembly (at its front side) that is to be applied to the panel frame indicated in FIGS. 2, 6 and 7.
Figure 5:
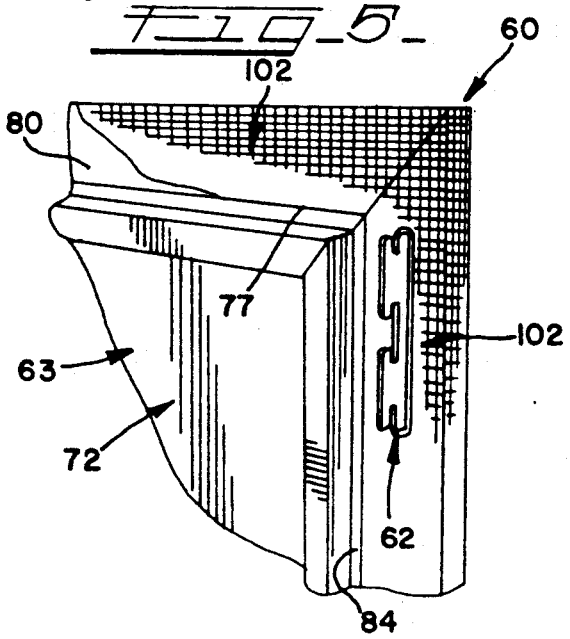
FIG. 5 is a view of the upper left hand corner of the acoustical insert frame assembly shown in FIG. 4, taken from the rear side of same, and more particularly illustrating a conventional hanger that is employed to mount the assembly of FIGS. 3–5 on the side rails of the panel frame.

In accordance with the present invention, the body 26 of the respective panels 12 is in the form of the acoustical insert frame assembly 60 that is diagrammatically illustrated in FIGS. 2 through 5, with the assembly 60 being illustrated in exploded form on a reduced scale in FIG. 3. Thus it will be apparent that in accordance with the present invention, the acoustical insert frame assembly 60 forms the panel body 26 of FIG. 1, as indicated in FIG. 1. As further indicated in FIGS. 5 and 7, the acoustical insert frame assembly 60 includes conventional hanger brackets 62 on either side of same that are applied to one of the elongate apertures 54 that are formed in the respective side rails 34 and 36 at the frame front and sides 56 and 58, to apply the acoustical insert frame assembly 60 to the panel frame frame side 56, with the hanger brackets 62 being applied to the respective apertures 54 at the elevation of rails 34 and 36 that will both fully align the acoustical insert frame assembly 60 with the panel frame 18 and center same with respect to its center opening 38 (In the specific form of FIG. 1, the body 26 of each panel extends between the decorated panel 28 of same and the top of the panel). In completing the formation of panel 12, its decorator panel 28 is applied where indicated in FIGS. 1 and 7 at any convenient point in the assembly procedure.

As indicated in FIG. 7, a portion 61 of the acoustical insert frame assembly 60, when assembly 60 has been applied to panel frame 18 as indicated, is in nesting relation within the frame center opening 38 at the front side 56 of the respective panel frames 18 whereby the front face 62 of the acoustical insert frame assembly 60 presents the smooth unbroken surfacing indicated for each panel 12 in FIG. 1, with each panel 12 thus providing a front side 64 to which the acoustical insert frame assembly 60 is applied, and an indented rear side 66 that for each panel 12 is made up of the rear side 58 of the panel frame 18 and what is seen from that side of the respective panels 12 insofar as the panel assembly and acoustical insert frame assembly 60 are concerned.

The acoustical insert frame assembly 60 comprises (see FIGS. 2 and 3) a supplemental frame 70, and an assembly body 63 formed by cutable or formable materials and comprising a honeycomb sound attenuation unit 72, a mat 74 formed from suitable acoustical fibrous material, such as fiber glass or suitable cellulose material, and a woven fabric 76 in sheet form.

The supplemental frame 70 comprises (see diagrammatic FIG. 3) top frame section 80, bottom frame section 82, and side frame sections 84 and 86 suitably joined together to provide the quadrilateral configuration indicated in FIG. 3, which is rectangular in the completed form of the panel bodies 26 (as indicated in FIG. 1). The frame members 80, 82, 84, and 86 are suitably formed from a suitable metal, such as a suitable steel, and are joined together in mitered relation at the respective supplemental frame corners by the practice of suitable welding techniques, or in any other suitable manner. The supplemental frame members 80, 82, 84, and 86 are of identical transverse cross-sectional configuration, and when assembled together in the manner indicated in FIG. 3 (frame 80 may also be of suitable one piece construction), they define four sided abutment flange 90 (see FIG. 7), the four sided transverse flange 92, the four sided abutment flange 94, and the four sided outer transverse flange 96. The flanges 90 and 92 define four sided seat 98 to which is applied the honeycomb unit 72, while the flanges 94 and 96 define seat 100. As indicated in FIG. 7, the honeycomb unit 72 is proportioned to just fill the seat 98, while the fibrous mat 74 overlies the unit 72 and fills the seat 100. A fabric 76 in sheet form is proportioned to fully cover the mat 74 and have its margins 77 folded and wrapped to the back side of the supplemental frame 70 (see FIG. 5) where its edgings 102 are bonded in place (using, for instance, a suitable glue) against the back side of the supplemental frame after the fabric 76 is smoothed on all sides of frame 70 against the mat 74. It is also preferable to suitably bond in place the honeycomb unit 72 against the flanges 90, as by employing a suitable glue for this purpose.

The honeycomb unit 72 in the form illustrated comprises a planar honeycomb core 110 formed to define a typical multitude of cells 112, a back or rear imperforate sheet 114 and a forward performated sheet 116, of which the individual perforations 118 are aligned with a specific cell 112, to form the individual cells 112 into a typical sound absorbing Helmholtz resonator. The sheets 114 and 116 are suitably bonded to the honeycomb core 110, with these components of the unit 72 being formed from cardboard or the like paper based material, as is the material forming cells 112. The rear sheet 114 is to act as a sound barrier while the forward sheet 116 in association with the mat 74 permits the unit 72 to act as a sound attenuator. Honeycomb units 72 of approximately ½ inch in minimum thickness are satisfactory for the practice of the present invention.

Honeycomb units 72 are available as such from International Honeycomb Corporation, of University Park, Ill.

The mat 74 is made up of a layer of fiberglass or cellulose fibers, or other acoustical materials for efficient sound attenuation achieved by the individual cells 112 of the unit 72 acting as Helmholtz resonators. In the form shown the mat 74 is a layer having a thickness of about ⅜ inch.

The fabric 76 may be of any suitable woven type and colored as desired to provide the decor that is to be presented by the individual panels 12, as viewed from the front sides 64 of same as shown in FIG. 1, as distinguished from their back or rear sides 66 (see FIG. 7).

In the specific form illustrated insofar as the acoustical insert frame assembly 60 is concerned, the hangers 62 that are associated with the supplemental frame members 84 and 86 are formed from the flange sections of these members that, in the assembled relation of frame 70, form the four sided abutment flange 94 of same, by suitable cutout and bending machine operations, as needed to properly form and position the hangers 62 on the respective supplemental frame members 84 and 86. Also, the cutable materials of the assembly body 63, namely, the unit 72, the mat 74, and fabric 76 are made fire resistant in any suitable manner.

It will thus be seen that the body 26 of the individual panels 12 provides, within the metes and bounds of the supplemental frame inner flange margins 119 (see FIG. 7) a relatively wide area of the front side of the panel (provided by assembly body 63) that is cutable or otherwise formable transversely through the body 26 of the panel, to define an aperture or apertures for passing or egress of cabling or wiring through the panel 12 in the manner indicated in FIG. 9, with the location or locations of such aperturing being at the option of the individual using the panel (either by itself, or at a work station such as work station 10). The needed aperturing to be formed in a particular panel 12 may be formed by employing suitable cutting tools, such as drills, etc. depending on the width of the aperture to be formed. As already indicated, it is suggested that the aperture formed be proportioned for force fitting of a grommet 120 (see FIGS. 2 and 9), of the type disclosed in said U.S. Pat. No. 4,688,491, for applying of such a grommet structure into the thus formed aperture, to bring the grommet edging 122 into flush relation with the panel fabric 76 at the front of the panel. This will result in the formation of a composite severed body 124 that may be pushed rearwardly through the panel 12 in question to form the needed aperture, after which the grommet 120 is put into place from the front side 64 of the panel by force fitting the grommet side wall 126 rearwardly of the panel, within the resulting aperture of the panel in question. As indicated in said patent, it is preferred that the side wall 126 of the grommet 120 should have a length that somewhat exceeds the thickness of the body 63 to which it is applied, and an internal diameter that preferably lies at least in the range of from about 2½ inches to about 3 inches, but it also could be larger or smaller, with the remainder of the grommet 120 and the aperture to be formed for same being proportioned accordingly. For this purpose, it is suggested that the cutting tool 130 (see FIG. 11) employed may take the form of a metallic tubular member 132 having a length of, for instance, approximately six inches, an external diameter that approximates the external diameter of the grommet side wall 126, of which the cutting end 134 is sharpened externally thereabout to define sharpened edge 136 and the opposed end 138 has a cross handle 140 mounted diametrically across same for manually applying thrust and torque to the tool 130 to form the body 124. The body 124 as formed is fully retained in the tool 130 (which is of the "cookie cutter" type), which tool 130 may be withdrawn from the front of the panel to remove body 124, leaving the resulting aperture through which the cabling or wiring is to be passed. Where such grommet 120 is not to be employed in connection with the panel 12, the cutting tool for forming a suitably sized aperture in assembling body 63 may be of the same type, but of an internal diameter somewhat exceeding the diameter of the cabling or wiring that is to be passed through the panel 12; where the cabling or wiring plug is to be passed through the panel 12, the internal diameter of the tool should be proportioned accordingly, so that such plug may be passed along with the cabling or wiring to which it is attached (to avoid removing such plug for passing the cabling or wiring through the panel body 26).

This invention thus provides for pre-use formation of the needed cabling or wiring egress aperture in a particular panel 12, but, of course, the aperturing formation can be done later, as needed. When the grommet 120 is employed it can be used in connection with panels 12 in a manner similar to that disclosed in said U.S. Pat.

In any event, assuming that for any particular panel 12, the panel 12 in question has been assembled in the manner hereindisclosed, the forward side 64 of the panel 12 provides the option of forming a cabling or wiring aperture transversely therethrough within the metes and bounds of the supplemental frame flange edging 119, across the height and width of the panel 12 for "in field" formation of the needed cabling or wiring apertures, with the location of same being at the option of the user of the panel 12 at any time that equipment is to be associated with the panel 12 that is of the electrical and/or electronic type requiring connection to a source of electrical energy, and this without having to prewire the panel 12.

Of course, the decor providing panel 28 may be omitted, in which case the assembly 60 should be proportioned accordingly (to overlie the entire frame 18, for instance).

Referring now to the showing of FIG. 8, this illustrates the panel 12A, which differs from panel 12 by having a second acoustical insert frame assembly 60 applied to the rear side 58 of frame 18 in the same manner as the assembly 60 already described (in detail) is applied to the front side 56 of frame 18. Both assemblies 60 are similarly proportioned to define hollow space 150 within the panel 12 that thus extends between the frame side rails 34 and 36 and its top and bottom rails 30 and 32, as well as the portions 61 (of the respective frame assemblies 60) that nest within the open center 38 of frame 18.

FIG. 9 illustrates the manner in which both panels 12 and 12A function to mask or pass wiring or cabling, even though FIG. 9 illustrates a panel 12A.

As is well known, power wiring or cabling is laid through a panel base 29, and also across the top of the panel but in a trough 152 (that is suitably fixed in place on frame top rail 30). Such wiring and cabling normally comprises power lines at the panel base and data and communication wiring and cabling at the top of the panel of, for instance, one of the types referred to hereinbefore. However the work needs at a specific location where a specific office furniture panel is located may result in a mixture of power lines and data and communication lines at the upper and lower ends of any panel involved.

In accordance with the present invention, the apertures 43 and 45, and a similar aperture 164 formed in trough 153, define in the frame a top wiring and cabling pull through port 160, and the apertures 47 and 49 of the bottom rail 32 define port 162 for the same purpose. Wiring and cabling from either the top or base of the respective panels 12 and 12A may be pulled or trained into the panel, behind the front assembly 60 of same, and exited at a pass through aperture located in the front assembly 60 front face 64 for extension to equipment of the electrical and/or electronic type at the work site provided by panels 12 or 12A; also, the wiring and cabling slack 164 may be fed back into the panel through such pass through aperture, as illustrated in FIG. 9; in the showing of FIG. 9 the panel aperture involved includes a grommet 120 that has been appropriately mounted on the panel front assembly 60 in the manner hereinbefore described. Of course, the aperture involved is located in the panel 12 or 12A at the option of the panel user (as hereinbefore described), and separate apertures may be used for wiring and cabling pass through and for slack masking purposes. Where it is desired to pass a particular wire or cable completely through a panel 12A, a second aperture is formed in the second assembly 60 in alignment with the first pass through aperture already mentioned (which may be done by the aperture former using the tool 130 from the front side of panel 12A).

It will thus be seen that the panel 12 provides an indented rear side 66, and panel 12A provides a hollow space 150, in which the wiring and cabling to be exited at each panel are masked as well as similar masking being provided for wiring and cabling slack, both together with the aforeindicated options for locating the panel front assembly 60 aperturing and a suggestion for lining same in the form of grommet 120.

In the showing of FIG. 10 the work station 170 is made up of three of the improved panels 12A connected together and otherwise arranged similarly to work station 10, except that the shelf 16 of FIG. 1 is eliminated and the work station 170 is conventionally provided with a conventional workspace 172 conventionally equipped with a conventional pedestal 174. The body 26A of one of the panels 12A is apertured as disclosed herein as at 176 in its front assembly 60 to pass through to a computer or the like 178 (indicated in dashed lines) resting on the workspace 172, and may have operably associated therewith wiring or cabling that conventionally is part of the wiring and cabling that may be in the panel top or base, or both and which is brought to the equipment 178 through the panel hollow space 150 and aperture 176 (as indicated by the dashed lines), which also show slack 164 that is pushed back through aperture 176 for masked storage within hollow space 150. The same wiring and cabling masking relation is provided by panel 12 (note its indented side 66).

It will thus be seen that the front face 64 of both panels 12 and 12A is the same, with the panel 12A having the advantage of providing sound attenuation for the rear of the panel. The basic purpose of both panels 12 and 12A is local (meaning adjacent the panel in question) accommodation (with masking) of data, communication and power providing wiring and cabling, and avoidance of conventional devices of the basket or flip-up panel type for masking cabling and wiring slack.

As to tackability of the front surface 64 of both panels, this is provided in that thumb tacks applied to the front assembly 60 of each panel will hold down one or several sheets bearing notes the worker (at the panel in question) may need to schedule his working, etc.; the T-pins, which should be inserted in the panel front face 64 within the aforementioned metes and bounds of the edging 119 (of the front assembly 60 supplemental flange 70), will reach and be lodged in the sheet 116 of the front assembly 60 unit 72, and are long enough to hold in place multisheet reports and the like.

Both the panels 12 and 12A will accommodate wiring and cabling of the various types indicated hereinbefore, and are made to resist indenting in use.

The assemblies 60 may also take the form of a set of relatively short assemblies to be applied in the same or a similar manner to the front side of frame 18, to, as a set, wholly cover same to provide color variation, a glazed appearance, etc.

The hereindisclosed panel arrangements can be used in any one of the work station configurations hereinbefore referred to.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. A panel of the office furniture type that defines a front side that forms the working side of the panel at which electrically operated equipment may be optionally located, and an opposite rear side, with the panel being arranged at a predetermined area of the panel front side for sound attenuation, and also for optional local accommodation capability and internal masking capability, of electrical conduiting for operating such electrically operated equipment, said panel comprising:

a rigid panel frame of open centered quadrilateral configuration including a rigid top, bottom, and side rail members fixedly assembled to form said panel frame and the front and rear sides thereof, and define an open space of quadrilateral configuration, with said rail members being disposed in marginal relation about said open space, and an insert frame assembly for application to said panel frame over and across said open space thereof at the predetermined area of the panel working side, said insert frame assembly having a rear side and a front side, and means for mounting said insert frame assembly on said front side of said panel frame with said rear side of said insert frame assembly in overlying relation to said panel frame and the front side of said insert frame assembly facing forwardly of said front side of said panel frame and the panel front side, said insert frame assembly comprising:

a rigid supplemental generally planar frame of outer and inner quadrilateral marginal configuration, and proportioned to extend between said panel frame side rail members when said insert frame is mounted on said panel frame, said inner marginal configuration of said supplemental frame assembly defining a planar space that is coplanar of said supplemental frame assembly, said insert frame assembly for the area of said supplemental frame space being comprised solely of a continuous and uninterrupted mass of acoustical masking material that has both sound attenuation characteristics and defines the panel predetermined area transversely of the panel, said material being constituted transversely thereof for electrical conduiting pass through providing aperture formation transversely of said insert frame assembly and anywhere within the metes and bounds of the panel predetermined area, whereby the panel at the predetermined area thereof provides the option of later in field providing of such aperture formation therein and anywhere within said metes and bounds of the panel predetermined area, for egress of such electrical conduiting transversely of the panel, as needed for operating such electrical equipment.

2. The panel set forth on claim 1, including:

a second insert frame assembly, that is the same as the first recited insert frame assembly, similarly mounted on the rear side of said frame, with said front side of said second assembly frame insert facing rearwardly of said rear side of said panel frame, and with said mass of said second insert frame assembly being aligned with the panel front side predetermined area transversely of the panel, said second insert frame assembly mass defining a predetermined area of the panel rear side that corresponds to that of the panel front side, said assemblies defining within said panel frame an open space in coplanar relation to said panel frame, whereby, the panel at its rear side provides the further option of later in field providing of such aperture formation in such predetermined area of the panel rear side and anywhere within the said metes and bounds of such panel rear side predetermined area for egress of such electrical conduiting transversely therethrough, as needed for operating such electrical equipment.

3. The panel set forth in claim 1 wherein:

the panel has pre-use mounted at the predetermined area thereof, in said mass, a grommet for pass through said insert frame assembly of such electric conduiting.

4. The panel set forth in claim 1 wherein:

said panel frame top and bottom rail members are each formed to define an electrical conduiting pull through port open to said panel frame open space, said panel frame and said open space defined thereby being coplanar, said ports being aligned longitudinally of said panel frame top and bottom rail members, respectively, whereby the panel at the predetermined area thereof provides the additional option of masking from the working side thereof such of the pulled through electrical conduiting that is disposed within said panel frame open space.

5. The panel set forth in claim 1 wherein:

said mass at the working side of the panel is tackable thereacross.

6. A panel of the office furniture type that defines a front side that forms the working side of the panel at which electrically operated equipment may be optionally located, and an opposite rear side, with the panel being arranged at a predetermined area of the panel working side for sound attenuation, and also for optional local accommodation capability and internal masking capability, of electrical conduiting for operating such electrically operating equipment, the improvement wherein the panel comprises:

a rigid panel frame of planar open center quadrilateral configuration including rigid top, bottom, and side rail members fixedly assembled to form said panel frame and the front and rear sides thereof, and define an open space of quadrilateral configuration in the plane of said frame, with said rail members being disposed in marginal relation about said open space, and with the said frame top and bottom rail members being formed to define electrical conduiting pull through ports that open in said plane of said frame and that are aligned longitudinally of said panel frame top and bottom rail members, respectively, and an insert frame assembly for application to said panel frame over and across said open space thereof at the predetermined area of the panel working side, said insert frame assembly having a rear side and a front side, and means for mounting said insert frame assembly on said front side of said panel frame with said rear side of said insert frame assembly in over relying relation to said panel frame and the front side of said insert frame assembly facing forwardly of the front side of said panel frame and the panel front side, said insert frame assembly comprising:

a rigid supplemental generally planar frame of outer and inner quadrilateral marginal configuration and proportioned to extend about said panel frame open space when said inset frame assembly is mounted on said panel frame, said inner marginal configuration of said supplemental frame defining a space that is coplanar of said supplemental frame, said supplemental frame defining first and second seats of quadrilateral configuration thereabout that are respectively planar in configuration and coplanar with said supplemental frame, said first seat of said supplemental frame being stepped rearwardly of said second seat thereof normally of said plane of said supplemental frame and forming said inner marginal configuration of said supplemental frame, and being disposed within said panel frame open space when said insert frame assembly is mounted on said panel frame, said second seat forming the outer marginal configuration of said supplemental frame and being at the front side of said supplemental frame, said insert frame assembly further comprising:

a first layer of acoustical honeycomb cell core having sound attenuation characteristics mounted on said first seat of said supplemental frame and extending across said supplemental frame open space, a second layer of fiber mat of acoustical characteristics mounted on said second seat across said first layer, and a woven fabric sheeting affixed across the front side of said insert frame assembly, said layers and said fabric sheeting of said insert frame assembly forming of a continuous and uninterrupted mass of acoustical masking material that both has sound attenuation characteristics and defines the panel predetermined area transversely of the panel, said material being formed for electrical conduiting pass through providing aperture formation transversely of said insert frame assembly and anywhere within the metes and bounds of the panel predetermined area, whereby, the panel at the predetermined area thereof provides the option of later in field providing of such aperture formation therein and anywhere within said metes and bounds of the panel predetermined area, for egress of such electrical conduiting, for operating as needed such electrical operated equipment, and whereby, the panel at the predetermined area thereof provides the further option of masking such of the pulled through electrical conduiting disposed within said panel frame open space.

7. The improvement set forth on claim 1, including:

a second insert frame assembly, that is the same as the first recited insert frame assembly, mounted on the rear side of said frame, with said front side of said second insert frame assembly facing rearwardly of said rear side of said panel frame, and with said mass of said second insert frame assembly being aligned with the panel front side predetermined area transversely of the panel, said second insert frame assembly mass defining a predetermined area of the panel rear side that corresponds to that of the panel front side, said assemblies defining within said panel frame an open space in coplanar relation to said panel frame for receiving such of the pulled through electrical conduiting for masking by said masses and said insert frame assemblies, respectively, whereby, the panel at its rear side provides the further option of later in field providing of such aperture formation in such predetermined area of the panel rear side and anywhere within the said metes and bounds of such panel rear side predetermined area for egress of such electrical conduiting transversely therethrough, as needed for operating such electrical equipment.

* * * * *